US009198485B2

(12) United States Patent
Kaltenrieder et al.

(10) Patent No.: US 9,198,485 B2
(45) Date of Patent: Dec. 1, 2015

(54) BRACELET CLASP COMPRISING A DEVICE FOR ADJUSTING THE USABLE LENGTH OF THE BRACELET

(71) Applicant: OMEGA SA, Bienne (CH)

(72) Inventors: Cedric Kaltenrieder, Bienne (CH); Rocco Catanese, Bienne (CH)

(73) Assignee: OMEGA SA, Bienne (CH)

( * ) Notice: Subject to any disclaimer, the term of this patent is extended or adjusted under 35 U.S.C. 154(b) by 82 days.

(21) Appl. No.: 14/086,340

(22) Filed: Nov. 21, 2013

(65) Prior Publication Data

US 2014/0150495 A1 Jun. 5, 2014

(30) Foreign Application Priority Data

Dec. 4, 2012 (EP) ..... 12195553

(51) Int. Cl.
*A44C 5/14* (2006.01)
*A44C 5/24* (2006.01)

(52) U.S. Cl.
CPC .. *A44C 5/14* (2013.01); *A44C 5/246* (2013.01)

(58) Field of Classification Search
CPC ..... A44C 5/246; A44C 5/2052; A44C 5/185; A44C 5/2042; Y10T 24/2155; Y10T 24/4782; Y10T 24/2147; Y10T 24/2166; Y10T 24/45188; Y10T 24/45267; Y10T 428/1352; Y10T 428/1372; Y10T 428/139; Y10S 24/46
USPC ..... 24/68–71 J; 63/3.2
See application file for complete search history.

(56) References Cited

U.S. PATENT DOCUMENTS

| | | | | |
|---|---|---|---|---|
| 4,675,955 | A * | 6/1987 | Nakamura | 24/656 |
| 4,928,359 | A | 5/1990 | Gagnebin | |
| 5,305,503 | A * | 4/1994 | Yamagata | 24/68 J |
| 5,313,691 | A * | 5/1994 | Hashimoto | 24/69 J |
| 5,711,056 | A * | 1/1998 | Taguchi et al. | 24/69 J |
| 5,749,128 | A * | 5/1998 | Cuche | 24/71 J |
| 5,787,554 | A | 8/1998 | Hashimoto | |
| 6,944,916 | B2 * | 9/2005 | Kawagoe | 24/71 J |
| 2007/0271747 | A1 | 11/2007 | Yamamoto | |
| 2009/0241597 | A1 * | 10/2009 | Robert et al. | 63/3.2 |

(Continued)

FOREIGN PATENT DOCUMENTS

| | | | |
|---|---|---|---|
| CH | 668 353 | A5 | 12/1988 |
| EP | 0 350 785 | A1 | 1/1990 |
| EP | 0 793 924 | A1 | 9/1997 |
| EP | 0 913 106 | A1 | 5/1999 |

(Continued)

OTHER PUBLICATIONS

European Search Report for EP 12 19 5553 dated Mar. 11, 2013.

*Primary Examiner* — Robert J Sandy
*Assistant Examiner* — David Upchurch
(74) *Attorney, Agent, or Firm* — Sughrue Mion, PLLC

(57) ABSTRACT

A bracelet clasp including an easily manipulated device of simple structure for adjusting the usable length of the bracelet by a firm adjustment, including when the clasp is open. The adjusting device is separate from the locking member, and the lock is arranged to move from its closed state to its open state by the user acting on the control member of the locking member such that the adjusting device is capable of being shifted independently of the open or closed state of the clasp. The clasp has a discrete structure, since it is actuated by the control member already provided for unlocking the clasp, although it is separate from the locking member of the clasp, and this additionally allows the length of the bracelet to be adjusted even when the clasp is in its closed state.

14 Claims, 5 Drawing Sheets

(56) References Cited

U.S. PATENT DOCUMENTS

2012/0240361 A1* 9/2012 Leger et al. ..... 24/265 EC
2013/0286797 A1* 10/2013 Leger ..... 368/282

FOREIGN PATENT DOCUMENTS

EP 1 379 185 A1 1/2004
EP 1 859 701 A1 11/2007

* cited by examiner

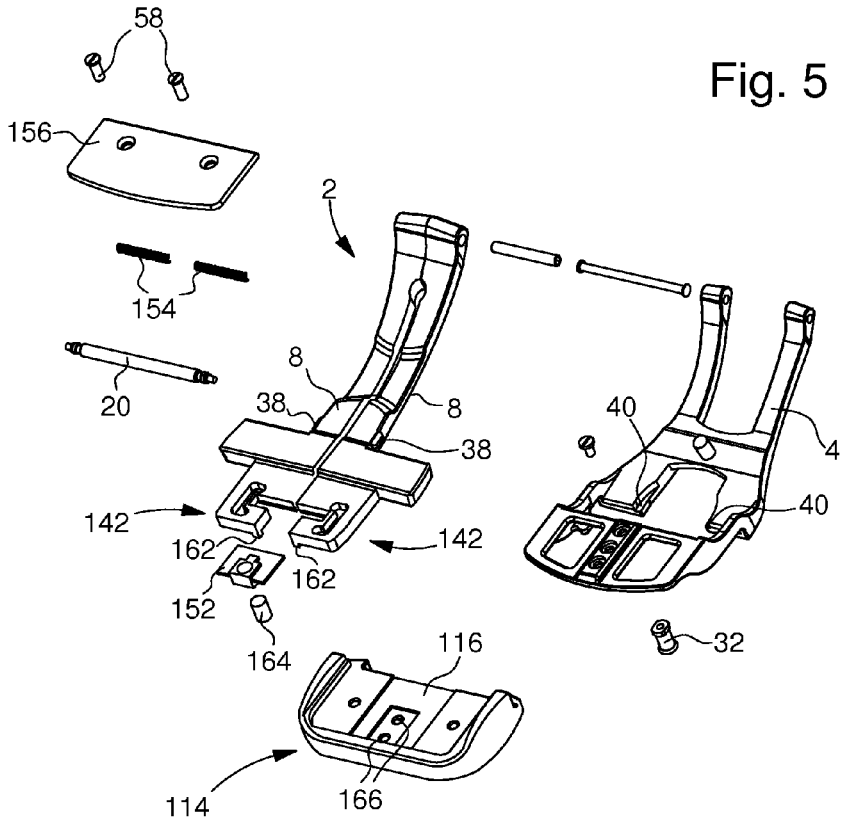
Fig. 5
Fig. 6
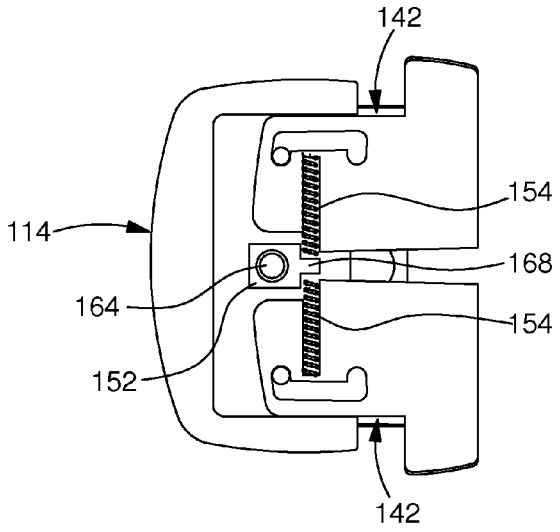

BRACELET CLASP COMPRISING A DEVICE FOR ADJUSTING THE USABLE LENGTH OF THE BRACELET

This application claims priority from European Patent Application No.12195553.8 filed Dec. 4, 2012, the entire disclosure of which is incorporated herein by reference.

TECHNICAL FIELD

The present invention relates to a bracelet clasp of the type comprising first and second free ends, wherein the clasp comprises first and second fastening members of the bracelet intended to be made respectively integral to the first and second free ends of the bracelet, wherein the fastening members are movable in relation to one another between at least one open position and a closed wearing position, in which they are closer to one another than in the open position, to close the bracelet and determine a usable length for it. The clasp comprises at least one locking member arranged to hold the fastening members of the bracelet in their closed position and at least one control member for the locking member arranged to unlock the clasp in response to an action of a user and to move from the closed position to the open position. In addition, the clasp according to the invention comprises a device for adjusting the usable length of the bracelet comprising an adjusting member, which bears the first fastening member of the bracelet and at least one lock capable of having a default closed state, in which the adjusting member is fixed, and an open state, in which the adjusting member is free to slide in the direction of the length of the bracelet with respect to the second fastening member of the bracelet to modify the usable length of the bracelet.

The present invention also relates to a wristwatch fitted with such a clasp.

STATE OF THE ART

The problems relating to the need to provide a device for adjusting the usable length of a bracelet are well known.

On the one hand, in the case of bracelets made from links, it is possible that the circumference value of the wrist of the wearer lies between two configurations of the bracelet that differ from one another by a single link. This is also the case when a bracelet made of leather, rubber or the like has perforations that do not allow for a sufficiently fine adjustment. Similarly, it is useful to provide a device for adjusting the usable length of the bracelet that will allow a finer adjustment of the length of the bracelet than the removal or addition of a link.

On the other hand, it is also known that the wrist circumference value varies depending on the seasons, wherein a maximum value is generally reached in summer and a minimum value is reached in winter. This is where it is further preferred to provide a device for the fine adjustment of the usable length of the bracelet that enables the wearer of the bracelet to adjust this length to improve the wearing comfort of the bracelet.

As an example, the patent application EP 09131060 A1 describes a deployment type clasp comprising a cover that has a series of pairs of holes intended to accommodate the ends of a fastening bar of a bracelet. Two pairs of adjacent holes are spaced at a distance defining an adjustment step for the usable length of the bracelet in response to the abovementioned problems.

However, adjustment of the length of the corresponding bracelet is difficult because it cannot be performed without using a pointed tool. Not only does this operation require a certain dexterity, but there is the additional risk of causing damage to the cover if the person performing the adjustment is clumsy.

To avoid such a situation, alternative devices have already been disclosed such as in patent EP 0350785 B1, for example, which describes a similar clasp to the above, but alternatively having a device for adjusting the usable length of the bracelet that can be manipulated without a tool. In fact, the clasp described in this patent is a deployment clasp-type clasp that has two blades articulated to one another by means of an arbor passing through both of them, wherein each of the blades has a member for fastening to a bracelet on its free end. A first blade bears a hook intended to engage into a hole arranged in the second blade to cooperate there with a spring catch that enables the hook, and thus the clasp, to be locked in a closed state. The second blade comprises two parts that are slidable in relation to one another in a certain predefined range defining a step in the adjustment of the usable length of the bracelet. A first of these two parts bears the hinge connecting it to the first blade, while the second part bears the locking spring catch. The hole in which the hook engages to lock the clasp has a length in the longitudinal direction of the bracelet that corresponds to the sliding range between the two parts of the second blade. The spring catch has a central part defining two positions for the hook in the longitudinal direction of the bracelet that correspond to two different usable lengths of the bracelet. A control member comprising in particular a push-piece allows actuation of the spring catch to release the hook and open the clasp.

Thus, the clasp described in this patent has to be open to proceed with adjustment of its length.

It may be pointed out that a resulting disadvantage thereof is that the adjustment of the length of the bracelet is lost each time the clasp is opened. Because of this, the wearer of the bracelet must ensure that the hook is inserted from the side of the central portion of the spring catch corresponding to the desired length for the bracelet.

Adjusting devices comprising a specific locking member have also been proposed as an alternative to prevent this kind of disadvantages.

The patent application EP 1378185 A1 provided an example thereof. However, these devices generally have complex and not very discrete structures since they can comprise at least one control member associated with the locking of the clasp and at least one additional control member associated with the locking of the adjusting device.

DISCLOSURE OF THE INVENTION

It is a main aim of the present invention to overcome the disadvantages of the known clasps of the prior art by proposing a bracelet clasp comprising an easily manipulated device of simple structure for adjusting the usable length of the bracelet by preferably proposing a firm adjustment, including when the clasp is open.

On this basis, the present invention more specifically relates to a bracelet clasp of the aforementioned type, characterised in that the adjusting device is separate from the locking member, and that the lock is arranged to move from its closed state to its open state by the user acting on the control member of the locking member such that the adjusting member is capable of being shifted independently of the open or closed state of the clasp.

Because of its features, the adjusting device according to the invention has a discrete structure, since it is actuated by the control member already provided for unlocking the clasp, although it is separate from the locking member of the clasp, and this additionally allows the length of the bracelet to be adjusted even when the clasp is in its closed state.

In general, it can be advantageously provided that the unlocking of the clasp is associated with a displacement of the control member of a first amplitude d1, and the unlocking of the adjusting member by the lock is associated with a displacement of the control member of a second amplitude d2, wherein d1 is less than d2.

Thus, it is possible to unlock the clasp without unlocking the adjusting member, and this guarantees that the desired adjustment is maintained during opening of the clasp, in contrast to the clasp of the prior art described above.

Moreover, the adjusting member preferably comprises a support structure that bears the first fastening member of the bracelet and at least one finger arranged to cooperate with the lock, and the latter comprises a plate, which is adjacent to the support structure and in which a slot is provided in the longitudinal direction of the bracelet. The slot has at least two notches capable of cooperating with the finger in the closed state of the lock to define two different respective usable lengths of the bracelet, whereas the finger is capable of sliding into the slot in the open state of the lock to pass from one notch to the other and modify the usable length of the bracelet.

According to a preferred variant, the support structure comprises upper and lower walls, between which the plate is arranged and the finger is in the form of a screw fixing the upper and lower walls to one another.

It can be additionally provided that the upper wall is formed by a cover comprising an upper surface bearing side walls having two holes intended to accommodate the ends of a fastening bar of a bracelet strand, and at least one support surface, against which the lower wall is held by means of the screw.

It can also be provided that the control member comprises a push-piece capable of being displaced in a substantially perpendicular direction to the longitudinal direction of the bracelet in response to an action of the user and that the lock is integral to the push-piece.

In general, it can be provided that the clasp has an additional control member, wherein the control members are similar and symmetrical with respect to the longitudinal direction of the bracelet and that the adjusting device comprises an additional lock associated with the additional control member, wherein the locks are similar and symmetrical with respect to the longitudinal direction of the bracelet, and an additional finger associated with the additional lock.

According to a preferred embodiment the clasp is a deployment type clasp comprising at least two blades articulated to one another, of which a first blade comprises two bars that are symmetrical with respect to the longitudinal direction of the bracelet and are inserted into a complementary recess of the second blade to place the clasp in its closed position by briefly bringing the bars closer against elastic restoring means, wherein the outer side edge of each of the bars cooperates with the corresponding inside edge of the recess to define a locking member of the clasp. Thus, it can advantageously be provided that each of the bars of the first blade bears one of the push-pieces and one of the locks. Each blade can be made in a single piece with the corresponding push-piece and lock.

In general, it can also be provided that the adjusting device comprises at least one elastic member that exerts a force on the lock or locks to endeavour to hold it or them in its or their closed state.

In this case the adjusting device preferably comprises an intermediate member that is in a fixed position with respect to the lock and has a support surface for an end of the elastic member.

The adjusting device can also comprise a stud catch associated with at least two complementary openings arranged to index at least two configurations corresponding to two different usable lengths of the bracelet. The stud catch can thus be carried by the intermediate member. In this case the openings can be arranged in the upper wall of the adjusting device.

BRIEF DESCRIPTION OF THE DRAWINGS

Other features and advantages of the present invention will become clearer upon reading the following detailed description of preferred embodiments with reference to the attached drawings given as non-restrictive examples:

FIG. 5 is an exploded perspective view of a bracelet clasp according to a preferred embodiment of the present invention when it is closed;

FIG. 6 is a simplified sectional view of a design detail of the clasp of FIG. 5.

EMBODIMENT(S) OF THE INVENTION

The clasp illustrated as non-restrictive example in the figures corresponds to a preferred embodiment of the present invention. More specifically, the clasp 1 is a deployment clasp-type clasp and is intended for clasp of a timepiece band.

Figure 1:
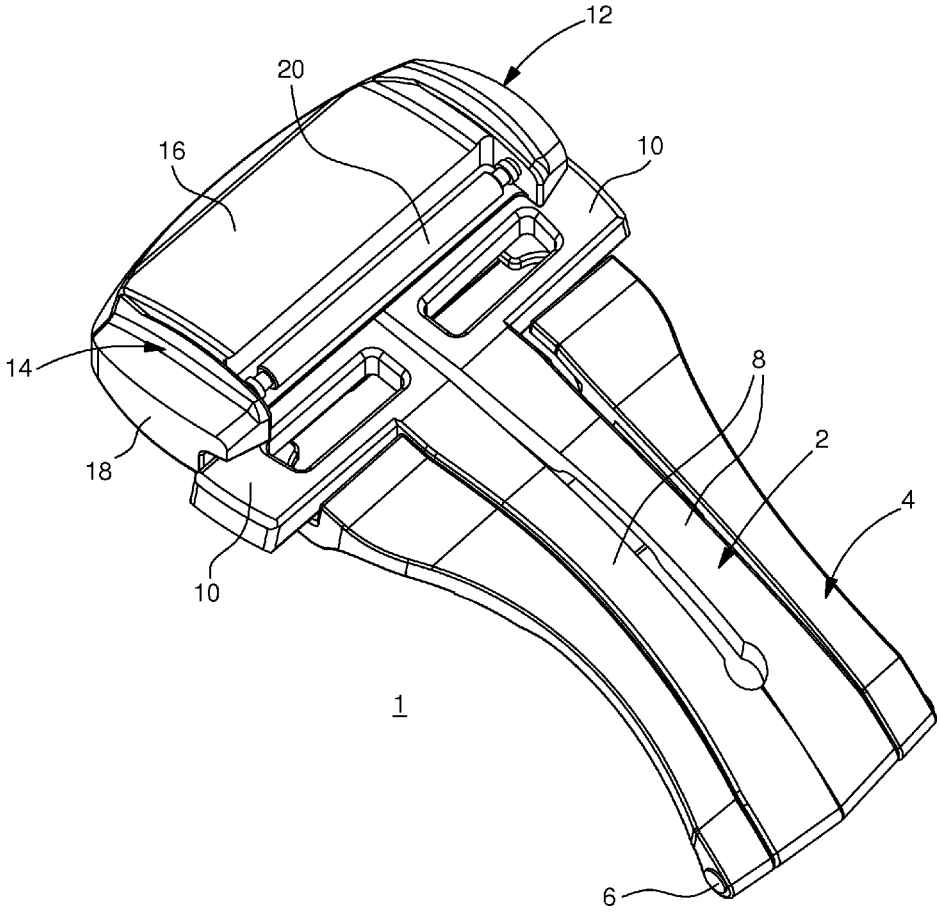
FIG. 1 is a simplified general perspective view of a bracelet clasp according to a preferred embodiment of the present invention when it is closed.

As is evident more specifically in FIG. 1, the clasp 1 comprises a first blade 2 articulated to a second blade 4 by means of an arbor 6 consisting here of a pin riveted to the blade 4 illustrated in a non-restrictive manner. Each of the blades has an elongated form in the longitudinal direction of the bracelet and is slightly curved to better mould to the shape of the wrist of a wearer.

The first blade 2 comprises two bars 8 arranged in contact with one another at their end located on the side of the arbor 6, each having a cut-out so that they are not in contact with one another over the largest portion of their length.

Figure 2:
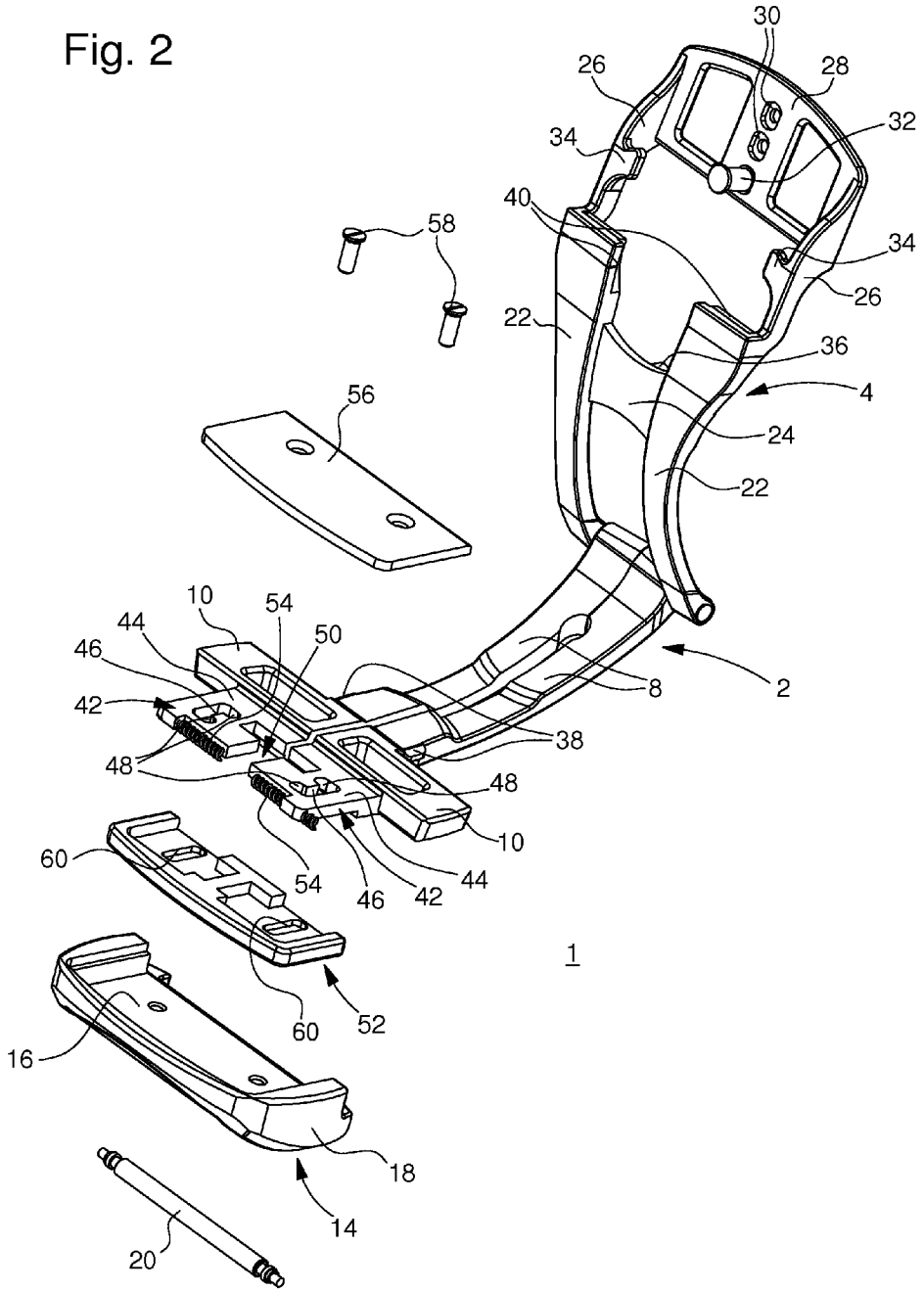
FIG. 2 is a partially exploded perspective view of the clasp of FIG. 1 when it is open.

Each of the bars 8 has an extension 10 close to its end remote from the arbor 6 that extends in a direction perpendicular to the longitudinal direction of the bracelet to form a push-piece that defines a control member that enables the clasp to be unlocked, as will be seen from the detailed description of FIG. 2.

In addition, the free end of the first blade 2 bears a device 12 for adjusting the usable length of the bracelet intended to be joined to the clasp 1.

The adjusting device 12 comprises a cover 14 that has an upper wall 16 bearing side walls 18. The side walls 18 are provided with two holes that allow an end of a fastening bar 20 of a bracelet strand to be accommodated in a conventional manner.

FIG. 2 shows an exploded perspective view of the clasp 1 when it is open.

It is evident from FIG. 2 that the second blade 4 comprises two arms 22 joined by a transverse bar 24 in their central region. The arms 22 are extended by bent portions 26 bearing a fastening plate 28 of a bracelet strand that is displaced in relation to the general direction of the arms 22 to define a passage for the bracelet strand.

The fastening plate 28 has a plurality of holes 30 regularly spaced from one another to allow placement of a round head pillar screw 32, which is intended to engage in a hole of the bracelet to assure fixture thereof to the clasp, and a screw (not shown) is screwed into the pillar screw 32. Each bent portion 26 additionally has a small lug 34 intended to improve the hold of the bracelet strand once it is positioned on the clasp 1. The transverse bar 24 bears an optional stud 36 or screw intended to engage in another hole of the bracelet to further improve its hold on the clasp 1. The screw 32 can be placed in one hole 30 or the other to define a space between it and the stud 36 that corresponds to a whole number of hole spacings arranged in the bracelet strand.

The space between the arms 22 of the second blade 4 defines a recess that allows the first blade 2 to be accommodated in the closed state of the clasp 1 in a known manner.

Conventional locking means are provided to assure the clasp is held in closed state. The outer edges of the bars 8 have thickened sections 38 close to the push-pieces 10 that are intended to cooperate with the inside edges of the second bar 4 at the recess by friction. In particular each inside edge of the second blade has a hollow 40, in which the corresponding thickened section of the first blade 2 is engaged when the clasp is closed. The cut-out made in each of the bars 8 clears a space allowing them to come closer to one another against elastic restoring means during the locking of the clasp or when the push-pieces 10 are actuated to release the thickened sections 38 from the hollows 40 to open the clasp.

The abovementioned patent application EP 09131060 A1 describes a clasp of this type in detail and a person skilled in the art could refer to it if needed.

Each push-piece 10 is extended by a lock 42 of the device for adjusting the usable length of the bracelet.

Each lock 42 comprises a plate 44 that has a slot 46 that is oriented in the longitudinal direction of the bracelet and has two notches 48 at its ends.

The locks are shaped to define a T-shaped opening between them that is intended to cooperate with an intermediate member 52 to ensure this is held with respect to the locks 42.

A first function of the intermediate member 52 is to provide support surfaces for a first end of springs 54, the second end of which rests against the corresponding plate 44, wherein these springs are arranged to hold the locks 42 in their closed state, as will be seen below in the detailed description of FIGS. 3 and 4.

A second function of the intermediate member is to act as a support to improve the structural stability of the adjusting device.

In fact, it is evident from FIG. 2 that the support structure of the adjusting device comprises a lower wall 56 joined integrally to the upper wall 16 of the cover 14 by means of two screws 58. The upper wall 16 and the intermediate member 52 also provide respective support surfaces, against which the lower wall 56 is arranged to thus improve the stability of the corresponding assembly.

The screws 58 are disposed through the slots 46 and also through appropriate slots 60 arranged in the intermediate member 52.

The locks 42 are thus arranged between the lower 56 and upper 16 walls and are held there as a result of the slots 46 cooperating with the screws 58.

The method of operation of the adjusting device according to the present invention will now be explained with respect to FIGS. 3 and 4, which show similar simplified sectional views of the adjusting device along a middle plane in first and second configurations respectively.

Figure 3:
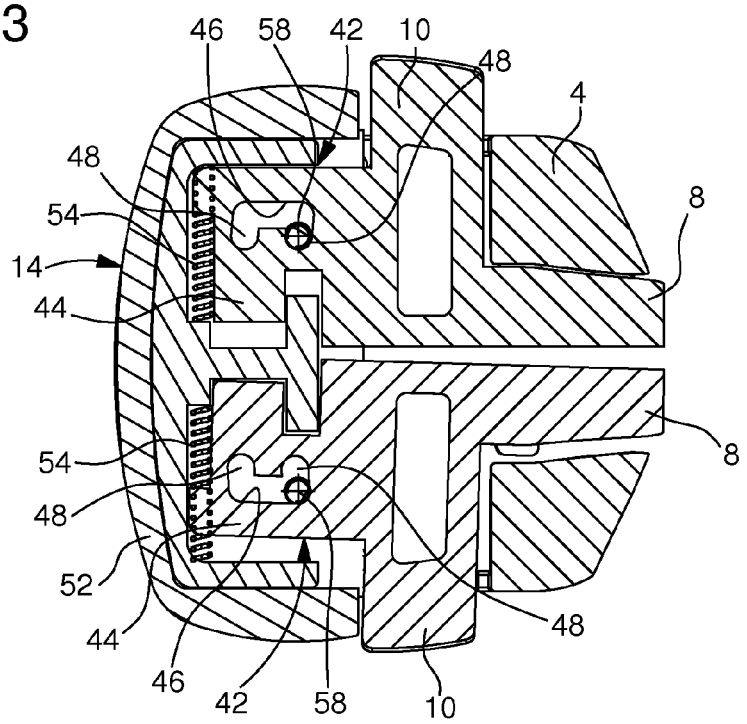
FIG. 3 is a simplified sectional view of a design detail of the clasp of FIG. 1 in a first configuration.
Figure 4:
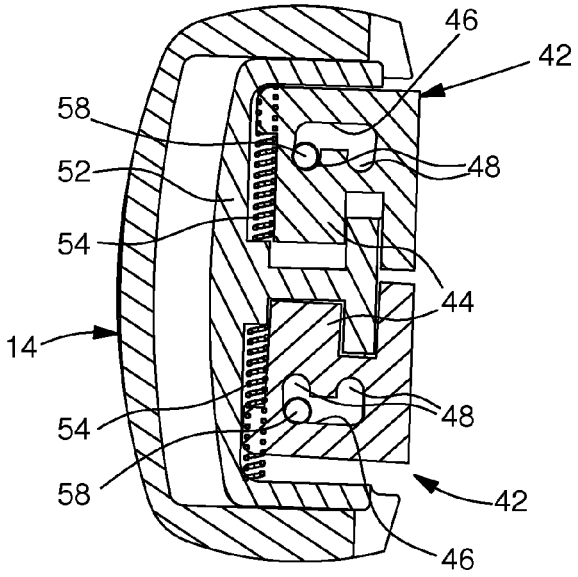
FIG. 4 is a similar view to that of FIG. 3 in a second configuration of the clasp.

More specifically, FIG. 3 corresponds to the long configuration of the clasp, i.e. the configuration in which the usable length of the bracelet is the largest, while FIG. 4 corresponds to its short configuration, i.e. the configuration in which the usable length of the bracelet is the shortest.

In each of these figures the upper half illustrates a first lock 42 in its closed state, while the lower half illustrates the second lock 42 in its open state.

When the push-pieces 10 are free, the shape of the bars 8 at rest assisted by the action of the springs 54 holds each lock 42 in a spread position corresponding to the closed state.

In this configuration each of the screws 58 is located in one of the notches 48 and the support structure cannot be shifted in the longitudinal direction or the bracelet with respect to the locks 42.

When the push-pieces 10 are actuated, the locks 42 come closer to one another to move into their open state (lower halves of FIGS. 3 and 4).

The notches 48 are shifted during the course of this operation and because of this the screws 58 are located in the axis of the slots 46 and are thus capable of sliding along the slots to come into a position facing one notch 48 or the other, depending on requirements. Thus, when a user actuates the push-pieces 10 to position the locks 42 in their open state, he/she can then move the cover 14 to shift it in the longitudinal direction of the bracelet to modify the usable length thereof. When the screws 58 are once again positioned facing one of the notches 48, and if there is no action on the push-pieces 10 by the user, the bars 8 resume their resting form as a result of the elasticity and simultaneous action of the springs 54. This action involves the return of the locks 42 to their closed state and therefore the locking of the adjusting member, which comprises the cover 16 associated with the lower wall 56 as well as the screws 58.

Comparing FIGS. 3 and 4, it is evident that in the configuration of FIG. 3, assuming that a bracelet is assembled on the clasp 1, the length of the superposed portions of the bracelet strands is smaller than this length in the configuration of FIG. 4, which means that the configuration of FIG. 3 corresponds to a usable length of the bracelet that is larger than that of FIG. 4.

Moreover, a comparison of the lower and upper halves of FIG. 3 shows that a first amplitude d1 of deformation of the bars 8 allows the clasp 1 to be unlocked, whereas a second amplitude of deformation d2 of the bars 8, which is higher than the first amplitude d1, is necessary to release the screws 51 and allow them to slide into the slots 56. It is thus possible in a preferred manner to provide by design that the clasp 1 can be open without modifying the adjustment performed with the adjusting device according to the present invention.

Moreover, this particular feature also allows the length of the clasp to be adjusted when said clasp is open and to then also advantageously maintain this adjustment.

Figure 7:
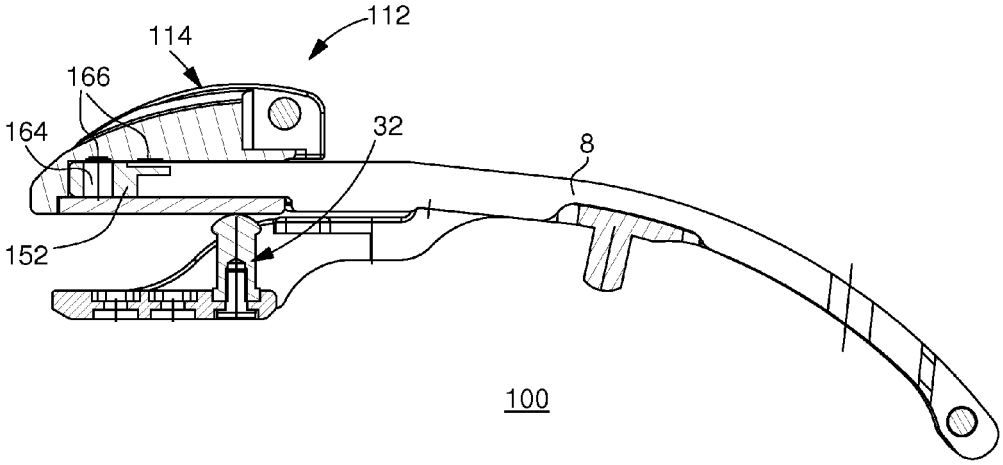
FIG. 7 is a longitudinal sectional view of the clasp of FIG. 5.

FIGS. 5 to 7 illustrate a variant of the clasp that has just been described. To simplify the present explanation, identical elements to those of the embodiment that has been described are given the same reference numbers and only the features that differ will be described in detail.

FIG. 5 shows a clasp 100 in its closed configuration in an exploded perspective view, this having a general structure that is identical to that of clasp 1.

The clasp 100 differs from clasp 1 in the structure of its device 112 for adjusting the usable length of the bracelet.

The adjusting device 112 comprises two locks 142 integral to the bars 108 of the first blade 102 of the clasp 100, wherein push-pieces 110 are also provided both for opening the clasp and to allow the locks 142 to move from their closed state to their open state.

An intermediate member 152 is arranged between the lower 156 and upper 116 walls of the adjusting device and held in the longitudinal direction of the bracelet by a thickened section 162 arranged on each of the locks 142.

Besides the functions already described relating to the intermediate member 52, the intermediate member 152 bears a stud catch 164 intended to assure indexation of the possible different adjustment configurations.

It is also evident from FIG. 5 that the upper wall 116 is provided with openings 166 intended to cooperate with the stud of the stud catch 164.

The arrangement of the adjusting device 112 is more clearly visible from FIG. 6, which shows it in a cross-sectional view along a middle plane.

The intermediate member 152 comprises a small lug 168 that defines two support surfaces for the first ends of springs 154 that act on the locks 142 in order to hold them in their closed state.

FIG. 7 shows the clasp 100 in longitudinal section and can thus better illustrate how the stud catch 164 cooperates with the upper wall 116 of the cover 114 to index the different adjustment positions possible for the clasp 100.

The clasp 100 is shown in its long configuration in FIG. 7. It is evident from the above explanations that if the cover 114 is displaced to the left in the figure, the bracelet (not shown) is shortened.

It is clear from the present description that the clasp according to the present invention comprises a device for adjusting the usable length of the bracelet that is simple in structure and easy to manipulate, while retaining a discrete aesthetic appearance and a reduced space requirement.

The above description endeavours to describe a particular embodiment by way of non-restrictive illustration and the invention is not restricted to the use of certain particular features that have just been described such as, for example, the forms specifically illustrated and described for the blades or also their way of cooperating to assure locking of the clasp. In fact, as an example, it is possible to alternatively use a hook- or spring catch-type locking member such as that described in patent EP 0350785 B1 mentioned above in relation to an adjustable clasp that is consistent with the features of the present invention.

A person skilled in the art will not encounter any particular difficulty in adapting the contents of the present disclasp to his own requirements and configuring a clasp, in particular for a timepiece without departing from the present invention. It will be noted, for example, that the adaptation of the present instruction for construction of a deployment buckle with a different structure from that illustrated and described will not pose any particular difficulty to a person skilled in the art.

Moreover, the clasp according to the present invention is not restricted to the use of two adjustment positions of the usable length of the bracelet. In fact, the person skilled in the art will likewise not encounter any particular difficulty in adapting the present instruction to configure a clasp that has a larger number of possible adjustment positions.

The invention claimed is:

1. A bracelet clasp comprising first and second free ends, wherein the clasp comprises first and second fastening members of a bracelet intended to be made respectively integral to the first and second free ends of the bracelet, wherein said fastening members are movable in relation to one another between at least one open position and a closed wearing position, in which they are closer to one another than in the open position, to close the bracelet and determine a usable length for it, at least one locking member arranged to hold said fastening members of the bracelet in their closed position, at least one control member for said locking member arranged to unlock the clasp in response to an action of a user and to move from said closed position to said open position, an adjusting device for adjusting the usable length of the bracelet comprising an adjusting member, which bears said first fastening member of the bracelet and at least one lock capable of having a default closed state, in which said adjusting member is fixed, and an open state, in which said adjusting member is free to slide in the direction of the length of the bracelet with respect to said second fastening member of the bracelet to modify the usable length of the bracelet, wherein said adjusting device is separate from said locking member, and that said lock is arranged to move from its closed state to its open state by the user acting on said control member of the locking member such that said adjusting member is capable of being shifted independently of the open or closed state of the clasp, wherein said adjusting member comprises a support structure that bears said first fastening member of the bracelet and at least one finger arranged to cooperate with said lock, wherein the latter comprises a disc, which is adjacent to said support structure and in which a slot is provided in the longitudinal direction of the bracelet, wherein said slot has at least two notches capable of cooperating with said finger in the closed state of said lock to define two different respective usable lengths of the bracelet, whereas said finger is capable of sliding into said slot in the open state of said lock to pass from one notch to the other and modify the usable length of the bracelet.

2. The clasp according to claim 1, wherein said support structure comprises upper and lower walls, between which said plate is arranged, and said finger is in the form of a screw fixing said upper and lower walls to one another.

3. The clasp according to claim 2, wherein said upper wall is formed by a cover comprising an upper surface bearing side walls having two holes intended to accommodate the ends of a fastening bar of a bracelet strand, and at least one support surface, against which said lower wall is held by means of said screw.

4. The clasp according to claim 1, wherein said control member comprises a push-piece capable of being displaced in a substantially perpendicular direction to the longitudinal direction of the bracelet in response to an action of the user, and that said lock is integral to said push-piece.

5. The clasp according to claim 4, wherein said clasp has an additional control member, wherein said control members are similar and symmetrical with respect to the longitudinal direction of the bracelet, and that said adjusting device comprises an additional lock associated with said additional control member, wherein said locks are similar and symmetrical with respect to the longitudinal direction of the bracelet, and an additional finger associated with said additional lock.

6. The clasp according to claim 5, wherein said clasp is a deployment clasp-type clasp comprising at least two blades articulated to one another, of which a first blade comprises two bars that are symmetrical with respect to the longitudinal direction of the bracelet and are inserted into a substantially complementary recess of the second blade to place the clasp in its closed position by briefly bringing said bars closer against elastic restoring means, wherein the outer side edge of each of said bars cooperates with the corresponding inside edge of said recess to define a locking member of the clasp, wherein each of said bars bears one of said push-pieces and one of said locks.

7. The clasp according to claim 6, wherein each of said bars is made in one piece with said push-piece and said corresponding lock.

8. The clasp according to claim 1, wherein said adjusting device comprises at least one elastic member that exerts a force on said lock or locks to endeavour to hold it or them in its or their closed state.

9. The clasp according to claim 8, wherein said adjusting device comprises an intermediate member that is in a fixed position with respect to said lock and has a support surface for an end of said elastic member.

10. The clasp according to claim 1, wherein said adjusting device also comprises a stud catch associated with at least two substantially complementary openings arranged to index at least two configurations of the adjusting device corresponding to two different usable lengths of the bracelet.

11. The clasp according to claim 10, wherein said stud catch is carried by said intermediate member.

12. The clasp according to claim 2, wherein said openings are arranged in said upper wall of said adjusting device.

13. The clasp according to claim 1, wherein unlocking of said clasp is associated with a displacement of said control member of a first amplitude (d1), and the unlocking of said adjusting member by said lock is associated with a displacement of said control member of a second amplitude (d2), wherein the first amplitude (d1) is less than the second amplitude (d2).

14. A wristwatch comprising a band fitted with a clasp of the type comprising first and second free ends, wherein the clasp comprises first and second fastening members of the bracelet intended to be made respectively integral to the first and second free ends of the bracelet, wherein said fastening members are movable in relation to one another between at least one open position and a closed wearing position, in which they are closer to one another than in the open position, to close the bracelet and determine a usable length for it, at least one locking member arranged to hold said fastening members of the bracelet in their closed position, at least one control member for said locking member arranged to unlock the clasp in response to an action of a user and to move from said closed position to said open position, an adjusting device for adjusting the usable length of the bracelet comprising an adjusting member, which bears said first fastening member of the bracelet and at least one lock capable of having a default closed state, in which said adjusting member is fixed, and an open state, in which said adjusting member is free to slide in the direction of the length of the bracelet with respect to said second fastening member of the bracelet to modify the usable length of the bracelet, wherein said adjusting device is separate from said locking member, and that said lock is arranged to move from its closed state to its open state by the user acting on said control member of the locking member such that said adjusting member is capable of being shifted independently of the open or closed state of the clasp and wherein said adjusting member comprises a support structure that bears said first fastening member of the bracelet and at least one finger arranged to cooperate with said lock, wherein the latter comprises a plate, which is adjacent to said support structure and in which a slot is provided in the longitudinal direction of the bracelet, wherein said slot has at least two notches capable of cooperating with said finger in the closed state of said lock to define two different respective usable lengths of the bracelet, whereas said finger is capable of sliding into said slot in the open state of said lock to pass from one notch to the other and modify the usable length of the bracelet.

* * * * *